US005479806A

United States Patent [19]

Benz

[11] Patent Number: 5,479,806

[45] Date of Patent: Jan. 2, 1996

[54] LEVELLING MACHINE, PARTICULARLY FOR LEVELLING SHEETS AND STRIPS

[75] Inventor: Willi Benz, Neuss, Germany

[73] Assignee: SMS Schloemann-Siemag Aktiengesellschaft, Dusseldorf, Germany

[21] Appl. No.: 210,910

[22] Filed: Mar. 21, 1994

[30] Foreign Application Priority Data

Mar. 19, 1993 [DE] Germany ..... 43 08 744.2

[51] Int. Cl.[6] ..... B21D 1/02

[52] U.S. Cl. ..... 72/165; 72/163

[58] Field of Search ..... 72/163–165, 160

[56] References Cited

U.S. PATENT DOCUMENTS

| | | | |
|---|---|---|---|
| 2,963,071 | 12/1960 | Krynytzky | 72/163 |
| 4,089,197 | 5/1978 | Ihle | 72/165 |
| 4,730,472 | 3/1988 | Ellis | 72/164 |

FOREIGN PATENT DOCUMENTS

| | | | |
|---|---|---|---|
| 162524 | 8/1985 | Japan | 72/165 |
| 170526 | 9/1985 | Japan | 72/165 |
| 187521 | 8/1987 | Japan | 72/163 |
| 214823 | 9/1987 | Japan | 72/164 |
| 166805 | 6/1989 | Japan | 72/164 |

*Primary Examiner*—Daniel C. Crane
*Attorney, Agent, or Firm*—Friedrich Kueffner

[57] ABSTRACT

A levelling machine, particularly for levelling sheet steel and strip steel, includes upper and lower levellerg rolls arranged offset relative to each other. The leveller rolls are supported by back-up rolls arranged in roll stands and supported in crossbeams. The back-up rolls support the leveller rolls over the length thereof. At least the upper crossbeam is adjustable by adjusting cylinders for positioning the leveller rolls. The upper roll stand and the upper crossbeam are mounted so as to be tiltable in travel direction of the material being levelled, so that compensating cylinders arranged between the roll stand and the crossbeam facilitate pivoted positions. The tilting points of the upper roll stand and of the upper crossbeam are arranged in several planes located one above the other.

4 Claims, 2 Drawing Sheets

LEVELLING MACHINE, PARTICULARLY FOR LEVELLING SHEETS AND STRIPS

BACKGROUND OF THE INVENTION

1. Field of the Invention

The present invention relates to a levelling machine, particularly for levelling sheet steel and strip steel. The levelling machine includes upper and lower leveller rolls which are arranged offset relative to each other. The leveller rolls are supported over the length thereof by means of back-up rolls arranged in roll stands and supported, in turn, by transverse crossbeams. At least the upper transverse cross beam is adjustable for positioning the leveller rolls by means of adjusting cylinders. Compensating cylinders are arranged between the roll stand and the transverse crossbeam.

2. Description of the Related Art

Levelling machines are known in the art in which the back-up rolls can be pre-adjusted in such a way that, taking into consideration the bending of the transverse crossbeams as a result of the levelling force, the bending of the levelling rolls is compensated and, thus, the leveller rolls are straight during levelling. For this purpose, the levelling machines may have upper and lower transverse yokes or crossheads and changing cassettes which are divided in the middle vertical transverse plane of the leveller rolls and are connected by joint connections in such a way that the cassette components including the groups of back-up rolls for the leveller rolls supported by the cassette components can easily be adjusted into a V-shape under idle running conditions. As a result of the levelling force, the crossheads are bent to such an extent that the preadjusted V-shape is cancelled, the groups of back-up rolls are in axial alignment and, thus, the leveller rolls are straight which is equivalent to a compensation of the bending of the crossheads. The crossheads, or at least the upper crosshead, are obliquely adjustable as a unit in the travel direction of the material being levelled by means of two pairs of adjusting devices which are supported on the machine columns, so that the depth of immersion of the offset leveller rolls can be adjusted so as to decrease from the entry side of the material to be levelled to the exit side for the distribution of overstretching. A different depth of immersion of the lower and upper levelling rolls which are arranged offset to each other serves for the adaptation to the column elongations which change or differ during entry and exit of the levelled material from the levelling machine.

In addition, the leveller rolls must be in contact even under idle running conditions with the groups of back-up rolls which are also arranged in a V-shape, which means that the leveller rolls must be pre-bent into a V-shape by means of forces acting on the ends thereof. Because of the substantially tilted position of the groups of back-up rolls, the extent of the prebending of the leveller rolls must be significant, so that the leveller rolls are subjected to significant bending forces until they are bent into the straight shape under the levelling force. Finally, there is the problem that in spite of the tilting yoke adjustment, the upper roll stand must be centered with the lower roll stand, so that an exact parallel position of the work rolls can be achieved and an always uniform gap or uniform pass line is possible. In addition, it is desirable to avoid complicated ball-and-socket joints and heavy ball-and-socket joint piles for transmitting the levelling forces.

SUMMARY OF THE INVENTION

Therefore, it is the primary object of the present invention to provide a levelling machine of the above-described type in which pivoting or tilting yoke adjustments are possible without the disadvantages described above.

In accordance with the present invention, the upper roll stand and the upper crossbeam are constructed so as to tilt in travel direction of the material being levelled and several tilting points arranged in planes located one above the other are provided.

In accordance with a recommended feature, the tilting points are arranged in the areas of the adjusting cylinders, the compensating cylinders and the upper leveller rolls. Advantageously, the tilting points are in the form of flat guide means. The flat guide means, which may be short and are arranged between the compensating cylinders and are pivotable in a range of play, produce tilting points which are substantially pivoting points which facilitate tilting of the upper crossbeam and of the roll stand and, thus, facilitate the desired tilting without the known disadvantages. Several of the short flat guide means are arranged in axial direction of the leveller rolls, i.e., distributed over the width of the levelling machine. The compensating cylinders provided for compensating the bending of the crossbeams between the roll stand and the crossbeam prevent the generation of a horizontal force because, in the case of an eccentric location of the levelling force, the cylinders react to the eccentric position by producing different forces and a corresponding counter moment.

In accordance with a further development of the invention, the roll stand and the crossbeam are provided with lateral guide means which have outer surfaces arched toward the machine column. The guide means are flattened on the sides and facilitate adjusting movements, on the one hand, and, on the other hand, support the pivoting movements of roll stand and cross beam achieved by the short, flat guide means.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described a preferred embodiment of the invention.

DETAILED DESCRIPTION OF THE PREFERRED EMBODIMENT

Figures 1, 3:
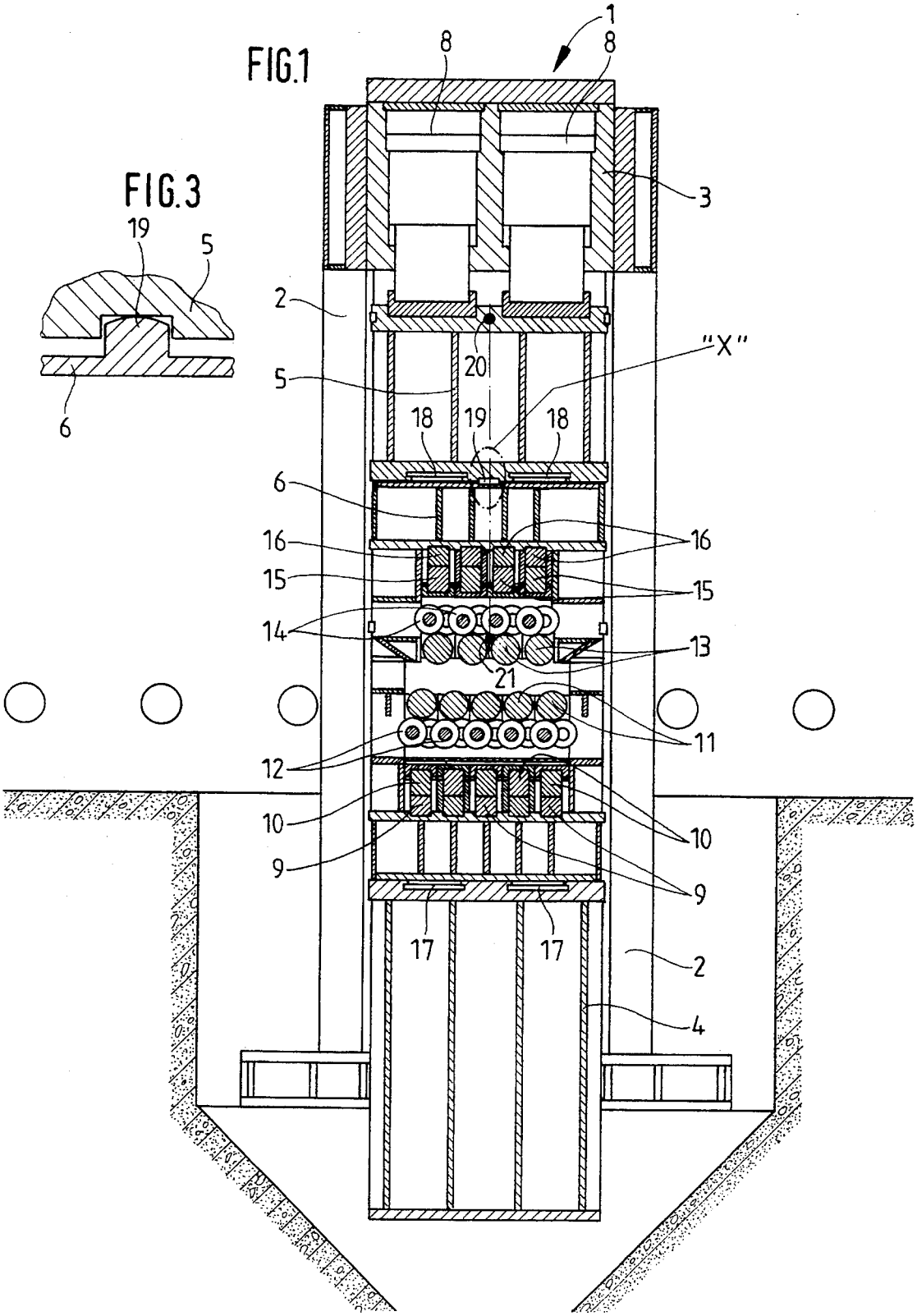
FIG. 1 is a longitudinal sectional view of a levelling machine according to the present invention.
FIG. 3 is a sectional view, on an even larger scale, showing a flat guide means as the detail marked by "X" in FIG. 1.
Figure 2:
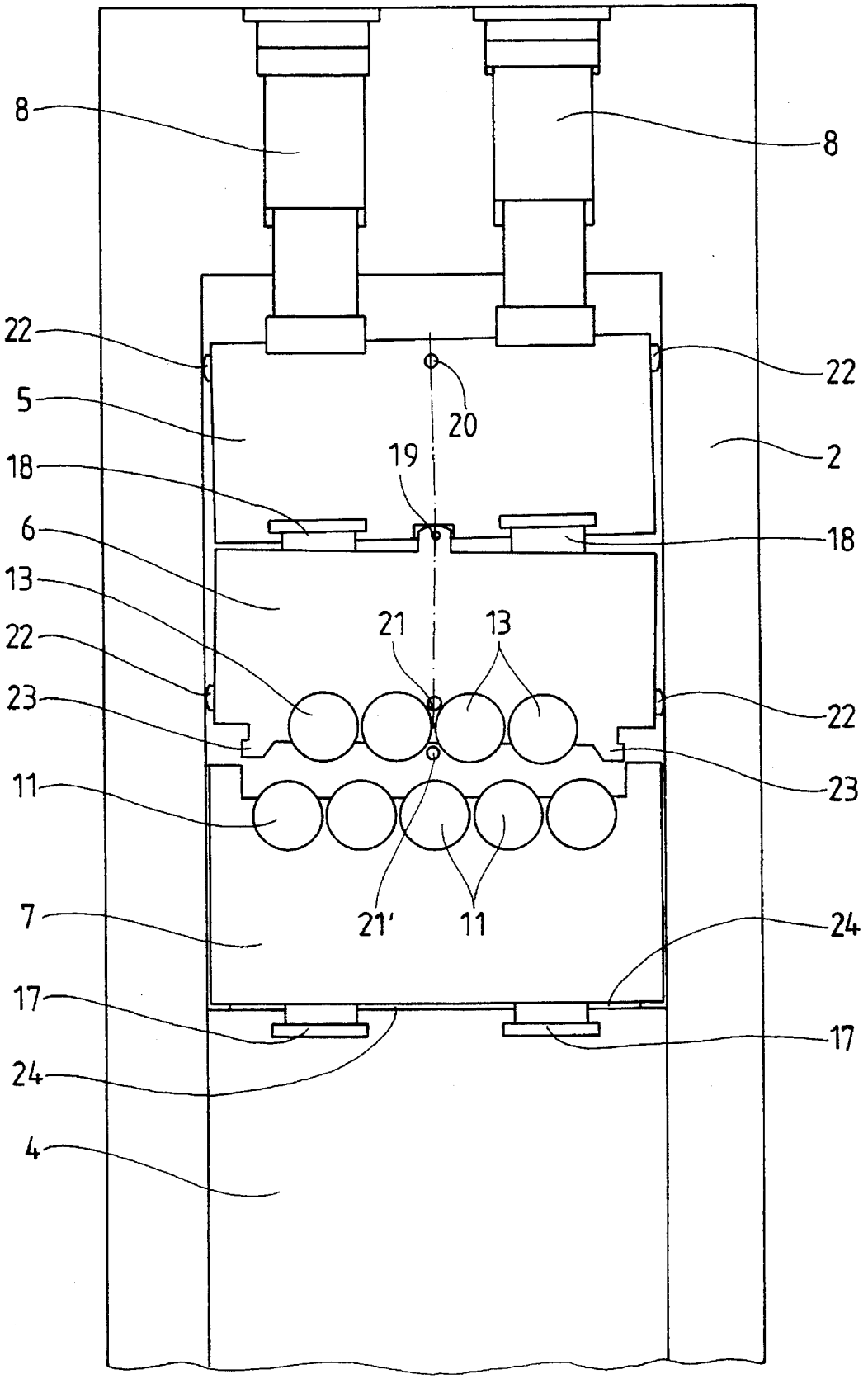
FIG. 2 is a schematic sectional view, on a larger scale, showing exaggerated tilted positions of the components of the levelling machine.

The roller levelling machine 1 shown in FIG. 1 of the drawing includes a machine frame formed by two columns or housings 2 which are anchored in a foundation. The columns 2 are rigidly connected to each other through an upper frame crossbeam 3 and a lower transverse crossbeam 4. The upper crossbeam 5 is adjustable and supports an upper roll stand 6. A lower roll stand 7 is arranged on the lower crossbeam 4. The lower roll stand 7 is mounted on and aligned by the crossbeam 4 through ledges 24 which are arranged on both sides of the levelling machine 1 in travel direction of the material being levelled, as can be seen in FIG. 2. The upper crossbeam 5 is adjustable relative to the lower crossbeam 4 through adjusting cylinders 8. Altogether four adjusting cylinders 8 arranged at the corners at the entry side and the exit side are in engagement with the upper crossbeam 5.

Roll adjusting wedges 9 are arranged on the lower roll stand 7. Each adjusting wedge 9 is displaceable by means of a pressure medium cylinder. A bearing carrier wedge 10 for lower levelling rolls 11 and back-up rolls 12 supporting the leveller rolls 11 is arranged for each adjusting wedge 9. Web plates which support the bearings of the leveller rolls are arranged between the back-up rolls 12. The bodies of several upper leveller rolls 13 are supported by means of back-up rolls 14 which are arranged between web plates of the upper roll stand 6. The upper leveller rolls 13 and the back-up rolls 14 are mounted on a bearing carrier wedge 15. Each of the adjacently mounted bearing carrier wedges 15 is supported on an adjusting wedge 16 whose other side rests on the upper roll stand 6. The adjusting wedges 16 are also displaceable by a pressure medium cylinder each. The upper and lower leveller rolls 11, 13 are individually driven and connected to a drive, not shown, through universal joint shafts.

The lower crossbeam 4 as well as the upper crossbeam 5 are supported on the entry side and the exit side relative to the roll stands 6 and 7 by means of external fixed stops, not shown, arranged symmetrically relative to the machine middle. Also provided on the entry side and the exit side are compensating cylinders 17 and 18, respectively, between the lower crossbeam 4 and the corresponding roll stand 7 and between the upper crossbeam 5 and the corresponding roll stand 6, wherein the compensating cylinders 17 and 18 are arranged with equal spacing from each other in a row between the fixed stops. Several short flat guide means 19, shown on a larger scale in FIG. 3, which are pivotable within a range of play, are arranged distributed over the width of the levelling machine 1 in the area between the compensating cylinders of the upper crossbeam 5. As shown in an exaggerated manner in FIG. 2, the flat guide means 19 form pivoting points which make it possible that the upper crossbeam 5 and the upper roll stand 6 can swing, so that tilting becomes possible. As a result of the flat guide means 19, there are three tilting or pivoting points which are arranged one on top of the other, namely, in the flat guide means 19, on the one hand, and, on the other hand, in the area of the adjusting cylinders 8, as indicated by reference numeral 20 in the drawing, and in the area of the upper leveller rolls 13, as indicated by reference numeral 21 in the drawing.

Lateral guide means 22 guide the upper roll stand 6 and the upper crossbeam 5 in the machine columns 2 during adjustments. The lateral guide means 22 are flattened at the top and bottom thereof, so that they face the machine column 2 with an arched outer surface which supports the tilting movements. The guide means 22 are located in a horizontal plane with the tilting points 20 and 21, respectively. The upper roll stand 6 has webs 23 which, in the position of operation, project into and engage the region of the lower roll stand 7, so that the tilting point 21 becomes ineffective and the new, downwardly displaced tilting point becomes effective.

The invention is not limited by the embodiments described above which are presented as examples only but can be modified in various ways within the scope of protection defined by the appended patent claims.

I claim:

1. A levelling machine for levelling sheets and strips, the levelling machine comprising a housing having a plurality of upper leveller rolls and a plurality of lower leveller rolls arranged offset relative to the upper leveller rolls, the leveller rolls having a length, further comprising an upper roll stand and a lower roll stand adjustably positioned within the housing of the levelling machine, back-up rolls and the leveller rolls arranged in each roll stand, an upper and lower crossbeam positioned within the housing for supporting the back-up rolls and leveller rolls, respectively, the back-up rolls supporting the leveller rolls over the length thereof, adjusting cylinders for adjusting at least the upper crossbeam relative to the housing for positioning the leveller rolls, compensating cylinders arranged between the roll stands and the crossbeams, the upper roll stand and the upper crossbeam being mounted so as to be tiltable relative to one another by the compensating cylinders and in a travel direction of the material being levelled, the upper roll stand and the upper crossbeam being tiltable about tilting points arranged in three planes located one above the other, wherein the upper crossbeam is tiltable relative to the upper roll stand and the upper roll stand is tiltable relative to the lower roll stand.

2. The leveling machine according to claim 1, wherein the tilting points are arranged in areas of the adjusting cylinders, of the compensating cylinders, of the upper leveller rolls and of webs of the upper roll stand projecting toward the lower roll stand.

3. The levelling machine according to claim 1, wherein flat guide means form the tilting points in the area of the compensating cylinders.

4. The levelling machine according to claim 1, wherein the upper roll stand and the upper crossbeam additionally comprise lateral guide means, the lateral guide means having arched outer surfaces facing a machine column in the housing.

* * * * *